US006616234B1

(12) United States Patent
King

(10) Patent No.: US 6,616,234 B1
(45) Date of Patent: Sep. 9, 2003

(54) ADJUSTABLE BACK FURNITURE

(76) Inventor: David Russell King, 61-67 Parramarra Road, Annandale NSW 2038 (AU)

( * ) Notice: Subject to any disclaimer, the term of this patent is extended or adjusted under 35 U.S.C. 154(b) by 0 days.

(21) Appl. No.: 09/763,234

(22) PCT Filed: Aug. 18, 1999

(86) PCT No.: PCT/AU99/00668

§ 371 (c)(1),
(2), (4) Date: Jul. 16, 2001

(87) PCT Pub. No.: WO00/10429

PCT Pub. Date: Mar. 2, 2000

(30) Foreign Application Priority Data

Aug. 18, 1998 (AU) ..... PP5323

(51) Int. Cl.[7] ..... B60N 2/02
(52) U.S. Cl. ..... 297/383; 297/440.16; 297/440.21
(58) Field of Search ..... 297/383, 283.3, 297/440.14, 440.21, 440.16

(56) References Cited

U.S. PATENT DOCUMENTS 2,645,788 A * 7/1953 Knoll et al.
2,784,769 A * 3/1957 Fisher
3,177,035 A 4/1965 Halstrick
3,256,533 A * 6/1966 Michelsen
3,823,429 A * 7/1974 Ambrose
4,447,920 A * 5/1984 Rosen
4,763,952 A * 8/1988 Gaudreau, Jr.

FOREIGN PATENT DOCUMENTS

DE 831 141 7/1949
WO 92/15228 9/1992

* cited by examiner

*Primary Examiner*—Milton Nelson, Jr.
(74) *Attorney, Agent, or Firm*—Browdy and Neimark, P.L.L.C.

(57) ABSTRACT

An article of furniture including an adjustable back which is held in place by at least one support member and a seat member, a first end portion of the support member and a second end portion of the support member being adapted for mounting to the seat member and to the back, each support member being invertible in a manner such that the back is held in either a first position or a second position, the effective depth of the seat member as defined by the distance from a front edge to a rear edge proximate the back being greatest when the back is in the second position.

10 Claims, 2 Drawing Sheets

ADJUSTABLE BACK FURNITURE

REFERENCE TO RELATED APPLICATIONS

The present application is the national stage under 35 U.S.C. 371 of international application PCT/AU99/00668, filed Aug. 18, 1999, which designated the United States, and which international application was published under PCT Article 21(2) in English.

TECHNICAL FIELD

The present invention relates to furniture and more particularly to articles of furniture such as lounge chairs and the like having an adjustable back.

BACKGROUND ART

Chairs are a well known article of furniture and generally include a seat member and a back. Chairs are designed for comfort, and may have armrests, upholstery, springs, and are usually proportioned according to the size of the human body. However, because different people have different physical proportions, a chair of fixed dimension does not provide comfort for all body types. In particular, known furniture does not provide means to adjust the depth of the seat member as defined by the distance from a front edge to a rear edge proximate the back, which would be desirable where people with legs of different length use the chair, or in general to provide the user with a choice, to satisfy personal preference.

DISCLOSURE OF INVENTION

The present invention provides an article of furniture comprising an adjustable back which is held in place by at least one support member and a seat member, a first end portion of the support member and a second end portion of the support member being adapted for mounting to the seat member and to the back, each support member being invertible in a manner such that the back is held in either a first position or a second position wherein the back is held in the first position when the first end portion is mounted to the back and the second end portion is mounted to the seat member, and wherein the back is held in the second position when the first end portion is mounted to the seat member and the second end portion is mounted to the back, the effective depth of the seat member as defined by the distance from a front edge to a rear edge proximate the back being greatest when the back is in the second position.

By providing the choice of two positions and two depths, the present invention provides the user of such an article of furniture with a choice of sitting position. For example the article of furniture may be adjusted depending on the height of the person using it, or in general to suit personal preference. Further, the simple manner in which the depth is adjusted allows an article of furniture in accordance with the present invention to be made relatively cheaply.

Each support member includes two end portions and preferably a middle portion intermediate the end portions. The end portions are preferably at all angle to each other, the angle preferably being chosen to provide a comfortable reclining position. The angle is preferably greater than 100 degrees, and more preferably is greater than 130 degrees. The angle is preferably less than 180 degrees and more preferably less than 170 degrees. It will of course be appreciated by persons skilled in the art that the optimum angle will vary depending on many factors, for example personal preference. In upholstered embodiments which include cushions, the optimum angle will depend on the extent of cushion filling.

The middle portion is preferably disposed such that the difference in depth between the first and second positions is dependent on the length of the middle portion and on the angle between the end portions.

Embodiments of the present invention may provide a single support member. In such embodiments anti-rotation means are preferably provided to prevent the back from rotating around the support member. The anti-rotation means may be effected by the use of a non circular cross section support member, for example a support member having a rectangular cross section. Alternatively, the anti-rotation means may be effected by a pin passing through a hole in the support member and into a corresponding recess, which for example may be located in the mount in or on the back and/or the mount in or on the seat member.

Preferred embodiments of the invention provide two support members, which are preferably equally spaced along the back.

In the article of furniture there is provided two or more support member mounts, the support member mount in or on the back and the support member mount in or on the seat each being adapted to removably accept either end of the support member. In one embodiment, each support member mount is provided by a recess to accept an end portion of the support member in a sliding fit. A clearance between the support member and an internal surface of the recess is preferably small compared to the cross sectional dimension of the support member in order to provide a close sliding fit. In embodiments where a single support member is used and the cross sectional shape of the support member is circular, it is desirable to provide anti-rotation means.

Embodiments of the invention may provide a stop on one or both of the end portions of the support member, such that the back is held substantially the same distance from the support member mount in or on the seat regardless of whether the back is in the first or second position. In such embodiments, the stop may be adapted to also act as an anti-rotation means.

Usually the article of furniture according to the invention will be upholstered.

The back and/or seat of the article of furniture may be sprung.

The support member may be fabricated by joining the individual portions. Alternatively the support member may be of unitary construction.

The article of furniture may be adapted to seat one person. Alternatively, the article of furniture may be produced to seat two or more people.

BRIEF DESCRIPTION OF DRAWINGS

Embodiments of the invention will now be described by way of example with reference to the accompanying drawings in which.

MODES FOR CARRYING OUT THE INVENTION

Figure 1A:
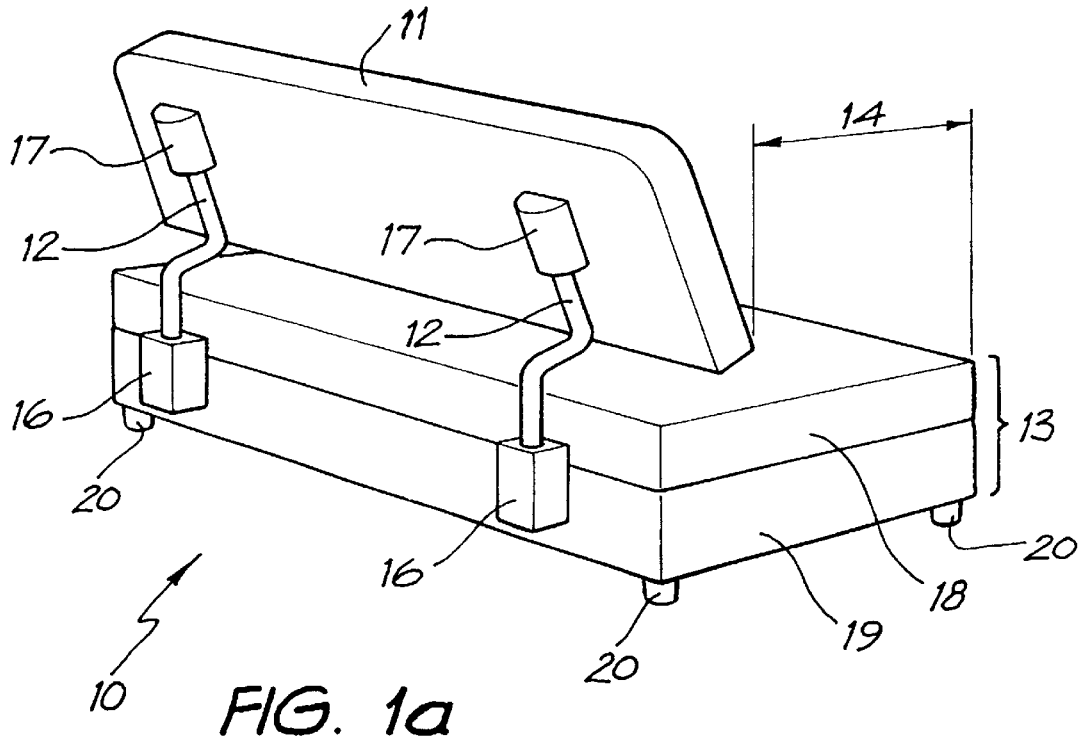
FIG. 1*a* illustrates an article of furniture according to the present invention with the back in the first position.
Figure 1B:
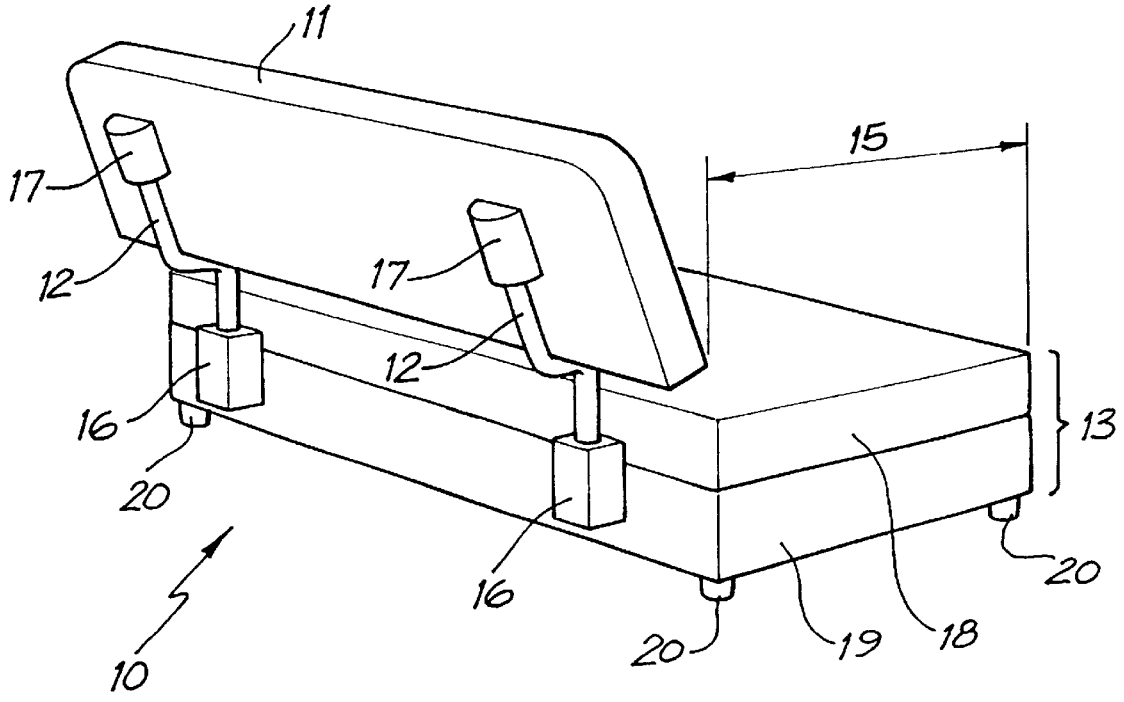
FIG. 1*b* illustrates an article of furniture according to the present invention with the back in the second position.

FIG. 1 shows an article of furniture 10 according to the present invention. The article of furniture 10 includes an adjustable back 11 which is held in place by support members 12 and a seat member 13, the support members 12 being invertible. In FIG. 1*a* the back 11 is held in a first position wherein the effective depth 14 of the seat member 13 is less than the depth 15 which results when the back 11 is held in a second position, as shown in FIG. 1*b*.

Seat member 13 includes a cushion 18, a base 19, feet 20 and support member mounts 16 on the seat. Back mounts 17 are on the back 11. In FIG. 1 the support members 12 are equally spaced along the back 11, providing stability and support for the back 11. The seat member preferably has a sturdy frame (not shown) to increase the strength of the article of furniture. The frame may be made of metal and/or wood or any other suitable materials.

Each support member 12 is inserted into a support member mount 16. Each support member mount 16 can accommodate either end of the support member 12, so that each support member 12 may be inverted. Each support member 12 fits closely into the respective support member mount 16, minimising unwanted movement of the back 11 during use.

In accordance with the preferred embodiment of the present invention, the article of furniture 10 is upholstered, and the back 11 and seat 13 of the article of furniture 10 are sprung.

Figure 2A:
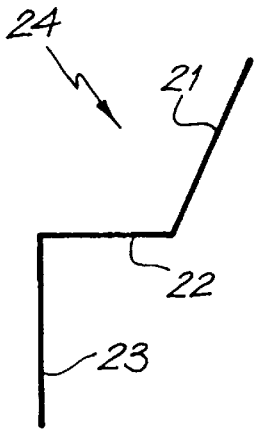
FIG. 2*a* shows a support member for use in the invention.
Figure 2B:
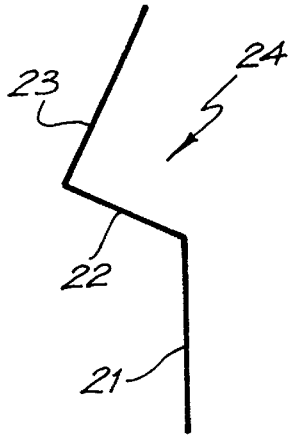
FIG. 2*b* shows the support member of FIG. 2*a* inverted.

FIG. 2 shows a line drawing of a support member 24 in accordance with the present invention. The support member 24 includes two end portions 21, 23 and a middle portion 22. The end portions 21 and 23 are at an angle ω of 155 degrees to each other, this angle being chosen to provide a comfortable reclining position. FIG. 2*a* shows the support member 24 positioned such that the back would be in a second position, and FIG. 2*b* shows the support member 24 in an inverted position, such that the back would be in a first position.

Figure 2C:
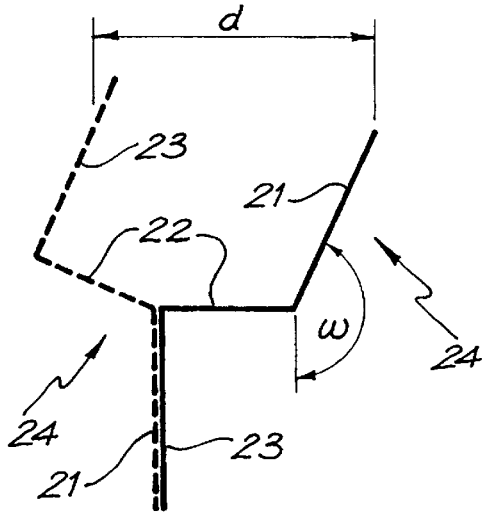
FIG. 2*c* shows the support member of FIG. 2*a* before and after inversion.

FIG. 2*c* illustrates the support member 24 both before and after it is inverted. As shown in FIG. 2*c*, the middle portion 22 is disposed such that the difference in depth d between the first and second positions is dependent on the length of the middle portion 22 and on the angle ω between the end portions 21, 23.

Although the middle portion 22 is shown as being substantially perpendicular to end portion 23 in FIG. 2, the middle portion 22 may be disposed at any suitable angle to end portions 21 and 23. In this case, the difference in depth between the first and second positions will further depend on the angle between the middle portion 22 and the end portions 21 and 23.

Figure 3:
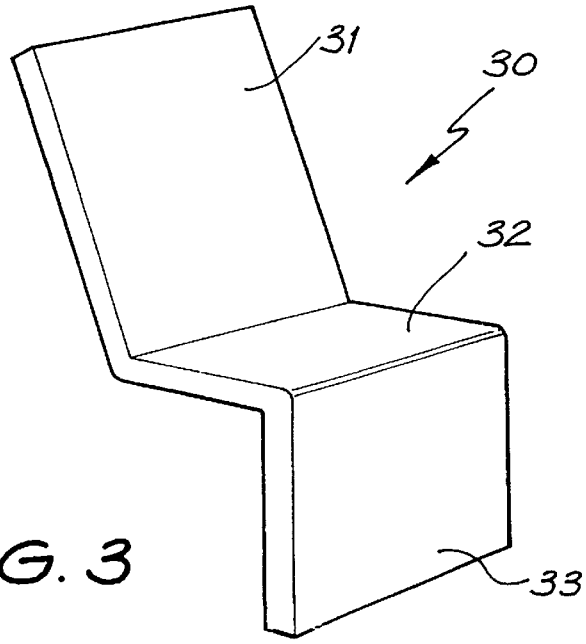
FIG. 3 shows another embodiment of a support member.

Alternate embodiments of the present invention may provide a single support member 30, such as that shown in FIG. 3. In such embodiments, if a circular cross-section support member were to be used, it is possible that the back would rotate around the support member. Rotation is prevented in the embodiment show in FIG. 3 by the use of a support member 30 having a rectangular cross section.

Although the invention has been described with reference to particular examples of the invention, it should be appreciated that it may be exemplified in other forms. For instance, in those embodiments where a single support member is used, rotation of the back around the support member may be prevented by any sort of fixing means. For example, the fixing means may be effected by a pin passing through a hole in the support member and into a corresponding recess, which for example may be located in the back and/or in the seat.

Embodiments of the present invention may provide the mount(s) in or on the seat and the mount(s) in or on the back in a number of ways. For example, the mounts may be provided by recesses in the seat member and back respectively.

The present invention may be implemented on each portion of a multi-portion article of furniture. For example, many lounges have a number of different portions which may be arranged in different configurations, for example to fit the furniture conveniently along a wall of a room, particularly where the wall is not straight. Each portion of such an article of furniture may have an adjustable back in accordance with the present invention.

Some embodiments of the invention may have a different angle between the first and second end portions of the support member. For example, in the case where the present invention is utilised as part of a multi-portion article of furniture, the multi-portion article of furniture may be arranged as a bed. In such embodiments of the invention, a low reclining angle may be desired, and therefore the angle between the two end portions of the support member may be reduced.

The support member may be fabricated by joining the individual portions. Alternatively, the support member may be of unitary construction.

The article of furniture may be adapted to seat one person. Alternatively, the article of furniture may be produced to seat two or more people. The article of furniture may be upholstered, have armrests and/or footrests, and be of any shape.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. An article of furniture comprising an adjustable back which is held in place by at least one support member and a seat member, a first end portion of the support member and a second end portion of the support member being adapted for mounting to the seat member and to the back, each support member being invertible in a manner such that the back is held in either a first position or a second position, wherein the back is held in the first position when the first end portion is mounted to the back and the second end portion is mounted to the seat member, and wherein the back is held in the second position when the first end portion is mounted to the seat member and the second end portion is mounted to the back, the effective depth of the seat member as defined by the distance from a front edge to a rear edge proximate the back being greatest when the back is in the second position, wherein the first end portion and the second end portion are at an angle to one another and the angle is chosen to provide a comfortable reclining position.

2. The article of furniture according to claim 1, wherein the angle is greater than 100°.

3. The article of furniture according to claim 2, wherein the angle is greater than 130°.

4. The article of furniture according to claim 1, wherein the angle is less than 180°.

5. The article of furniture according to claim 4, wherein the angle is less than 170°.

6. The article of furniture according to claim 1, wherein anti-rotation means is provided to prevent the back from rotating around the support member, the anti-rotation means being effected by the use of a non-circular cross section support member.

7. The article of furniture according to claim 6, wherein the anti-rotation means is effected by the use of a support member having a rectangular cross section.

8. The article of furniture according to claim 6, wherein the anti-rotation means is effected by a pin through a hole in the support member.

9. The article of furniture according to claim 1, wherein the seat member has a seat member mount for mounting each support member, the seat member mount being provided by a recess adapted to accept each end portion of the support member in a sliding fit, wherein a clearance between the support member and an internal surface of the recess is small compared to the cross sectional dimension of the support member.

10. The article of furniture according to claim 9, wherein a stop is provided on at least one of the end portions of each support member, such that the back is held substantially the same distance from the seat member mount in both the first position and the second position.

* * * * *